US007915507B2

(12) United States Patent
Onheiser

(10) Patent No.: US 7,915,507 B2
(45) Date of Patent: Mar. 29, 2011

(54) METHODS AND APPARATUS FOR MOUNTING CYMBALS

(76) Inventor: Stephen Carol Onheiser, Baltimore, MD (US)

( * ) Notice: Subject to any disclaimer, the term of this patent is extended or adjusted under 35 U.S.C. 154(b) by 148 days.

(21) Appl. No.: 11/941,222

(22) Filed: Nov. 16, 2007

(65) Prior Publication Data

US 2008/0127805 A1 Jun. 5, 2008

Related U.S. Application Data

(60) Provisional application No. 60/866,088, filed on Nov. 16, 2006, provisional application No. 60/912,520, filed on Apr. 18, 2007, provisional application No. 60/954,165, filed on Aug. 6, 2007, provisional application No. 60/973,822, filed on Sep. 20, 2007.

(51) Int. Cl.
*G10D 13/02* (2006.01)

(52) U.S. Cl. ..... 84/421; 84/402; 84/411 R

(58) Field of Classification Search ..... 84/421
See application file for complete search history.

(56) References Cited

U.S. PATENT DOCUMENTS 1,607,769 A 11/1926 Meyer
2,163,949 A * 6/1939 Kiemle ..... 84/402
3,994,198 A * 11/1976 Herman ..... 84/421
4,216,695 A * 8/1980 Hoshino ..... 84/421
4,263,246 A * 4/1981 Mercer ..... 264/230
4,526,083 A 7/1985 LeMert
4,960,028 A 10/1990 Ramirez
5,353,472 A 10/1994 Benda et al.
5,808,217 A 9/1998 Liao
5,856,635 A 1/1999 Fujisawa et al.
2004/0094016 A1 5/2004 Hallerberg
2004/0182222 A1 * 9/2004 Demers et al. ..... 84/422.3

* cited by examiner

*Primary Examiner* — Elvin G Enad
*Assistant Examiner* — Christopher Uhlir
(74) *Attorney, Agent, or Firm* — Edell, Shapiro & Finnan, LLC

(57) ABSTRACT

A pliable and resilient mounting grommet, forced into deployment in a cymbal aperture, is secured to a cymbal, rather than to the cymbal support rod, and includes a reduced diameter neck residing in the cymbal aperture. The cymbal and grommet may be removed as a unit from a support rod and placed on another support rod. A non-metal rigid washer may be permanently bonded to the bottom surface of the grommet to prevent the grommet from slipping down along the support rod. The grommet may be interiorly reinforced with strengthening material at the neck portion. A thumbscrew having a soft bottom portion may be used to tighten the cymbal in place.

26 Claims, 9 Drawing Sheets

METHODS AND APPARATUS FOR MOUNTING CYMBALS

CROSS REFERENCE TO RELATED APPLICATION

This application claims priority from U.S. Provisional Patent Application Ser. Nos.: 60/866,088 entitled "Method and Apparatus for Mounting Cymbals" filed Nov. 16, 2006; 60/912,520 entitled "Washer for Cymbal Mounting Arrangement" filed Apr. 18, 2007; 60/954,165 entitled "Cymbal Mounting Arrangement With Improved Strength," filed Aug. 6, 2007; and 60/973,822 entitled "Cymbal Mounting Arrangement" filed Sep. 20, 2007. The disclosures in those provisional patent applications are incorporated herein by reference in their entireties.

FIELD OF THE INVENTION

The present invention pertains to improvements in mounting cymbals on cymbal stands.

BACKGROUND

Conventional stands for mounting cymbals comprise a rod or pole having a threaded section at its upper end that is inserted through a central aperture in the cymbal. See, for example, U.S. Pat. Nos.: 1,607,769 (Meyer); 3,994,198 (Herman); 4,216,695 (Hoshino); 4,526,083 (LeMert); and 5,808,217 (Liao). The disclosures in those patents are incorporated herein by reference in their entireties. The cymbal typically rests on an annular shoulder that may be formed as a diametrically widened section of the rod, and is secured to the rod by a wing nut, or the like, that threadedly engages the threaded upper section of the rod. It is conventional for an annular cushion of felt or similar material to serve as an intermediate support and is disposed about the rod immediately below the cymbal. The rod is typically provided with a tripod lower section for supporting the rod on a floor or other surface; see, for example, the aforementioned Herman patent. The wing nut arrangement permits the cymbal to be readily removed from the stand for storage or transport and to be mounted on other stands.

The cymbal, in use, must be mounted on the rod in a manner to prevent the mounting from damping the vibrations when the cymbal is struck. The extent to which the wing nut is tightened is often a matter of preference for each percussionist. In other words, the cymbal should be able to tilt or wobble somewhat when struck to the extent desired by the percussionist. When so mounted, the interior annular edge defining the cymbal aperture tends to wear against the rod as the cymbal wobbles until the aperture becomes irregular in shape and/or too large for suitable mounting purposes. This problem is tacitly recognized in U.S. Pat. No. 2,163,949 (Kiemle) in which a resilient rubber plug is disclosed and adapted to be mounted on the top of the cymbal stand. The plug includes a small diameter intermediate neck portion that extends through the cymbal aperture and requires a separate grommet to be inserted into the cymbal aperture and surround the plug neck. The Kiemle arrangement does not permit the cymbal to be readily removed from the stand and, if removed, the plug remains on the stand, not with the removed cymbal.

SUMMARY OF THE INVENTION

In accordance with one aspect of the present invention, a pliable and resilient mounting grommet is secured to a cymbal, rather than to the cymbal stand, in the cymbal central aperture and includes a relatively large diameter base or lower portion, a reduced diameter neck and an annular upper flange of greater diameter than the neck and the cymbal aperture. A central bore extends longitudinally through the grommet and has a diameter approximately equal to or slightly larger than the diameter of the upper portion of a conventional cymbal support stand. The one-piece unit, preferably integrally molded, is mounted on the cymbal by resiliently distorting the upper flange while forcing that flange through the cymbal aperture. Once the grommet is inserted, the annular edge of the cymbal aperture is securely disposed between the grommet base and upper flange. In this manner the mounting grommet is readily removed from the stand along with the cymbal for storage, transport or mounting on another stand. The grommet protects the annular edge of the cymbal aperture from wear against the rod of the support stand during use without restricting desired tilt or wobble. The wing nut that threadedly engages the upper end of the rod can be tightened to the desired degree by resiliently compressing the upper flange of the grommet longitudinally downward along the rod.

In many instances it is desirable to utilize the grommet of the present invention with a washer disposed below the grommet on the support stand rod to provide a base support that prevents the grommet from slipping past the annular stop or shoulder that is provided on the rod to establish the vertical position of the cymbal. In some cases there is no such washer on the support rod due to the fact that it may have been lost or not provided when the stand was purchased. In accordance with another aspect of the present invention, a non-metal rigid washer may be permanently bonded to the bottom surface of the grommet to serve the function of preventing the grommet from slipping past the annular stop or shoulder.

Another aspect of the present invention involves strengthening the grommet to reduce wear and tear. In particular, a strengthening material is embedded in the neck or small diameter portion of the grommet, preferably by an insert molding process. The material is preferably a mesh sleeve which can be similar to woven steel braiding used for coaxial cable shielding but is preferably not metallic. Examples of preferred material for the mesh sleeve are carbon nanotubes, aramid (i.e., aromatic polyamide) fibers such as KEVLAR, high strength glass fibers, graphite fibers, graphite whiskers and silicon carbide fibers or graphite fibers. Metal, although not a preferable material, may also be used. Broadly speaking, the fiber material may be any fiber suitable for the described strengthening function and for embedding in the grommet during molding.

The grommet of the present invention is configured to have a radially small top flange so that the grommet can be installed easily in the cymbal aperture, and also to minimize the contact area with the cymbal surface. However, if a standard attachment wing nut is used, the "thumb wings" of the nut extend radially well beyond the circumference of the grommet top flange. In extreme circumstances a cymbal could deflect enough to contact one of the extended nut wings. One solution to this problem would be to place a standard felt washer between the grommet (or the cymbal mounted without such a grommet) and the attachment nut. Unfortunately the soft nature of the felt does not allow the proper mounting pressure to be applied to the grommet, resulting in reduced life of the grommet. There is also the issue of the larger diameter of the felt spacer overhanging the smaller top flange of the grommet and contacting the top of the cymbal. Thus, the reduced contact concept of the grommet of the present invention would be somewhat compromised. Additionally, it can be said that any object extending into a desired playing area of the cymbal reduces that available playing area. Accordingly, another aspect of the present invention involves the use of a thumbscrew, rather than a wing nut, having a rubber or plastic compound base section to contact the cymbal, or the grommet if the grommet is used. The thumbscrew is used to attach the cymbal and at the same time enhance the usefulness of the grommet the present invention, if such a grommet is used. The thumbscrew places a focused area of sufficient pressure on the grommet to minimize excessive tilt of the cymbal and thus improve the wear performance. Eliminating the need for a top felt washer means that fewer parts are required and also keeps the contact area of the mounting device on the cymbal to a minimum. Further, use of the thumbscrew allows for a percussionist to strike the cymbal closer to its center without impedance, if desired.

The above and still further features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

The following detailed explanations of FIGS. 1-14 and of the preferred embodiments reveal the methods and apparatus of the present invention.

Figure 1:
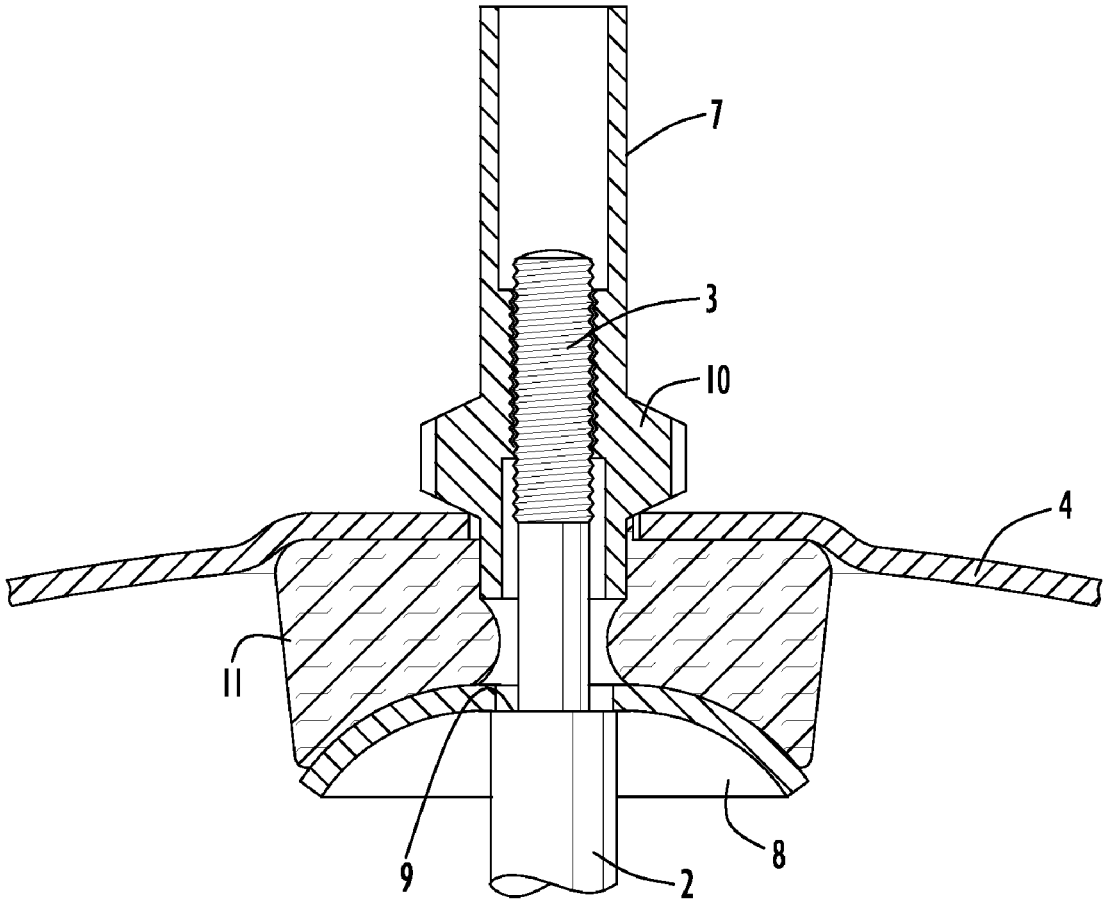
FIG.1 PRIOR ART
FIG. 1 is an elevation view in section of a prior art cymbal mounting arrangement.
Figure 14:
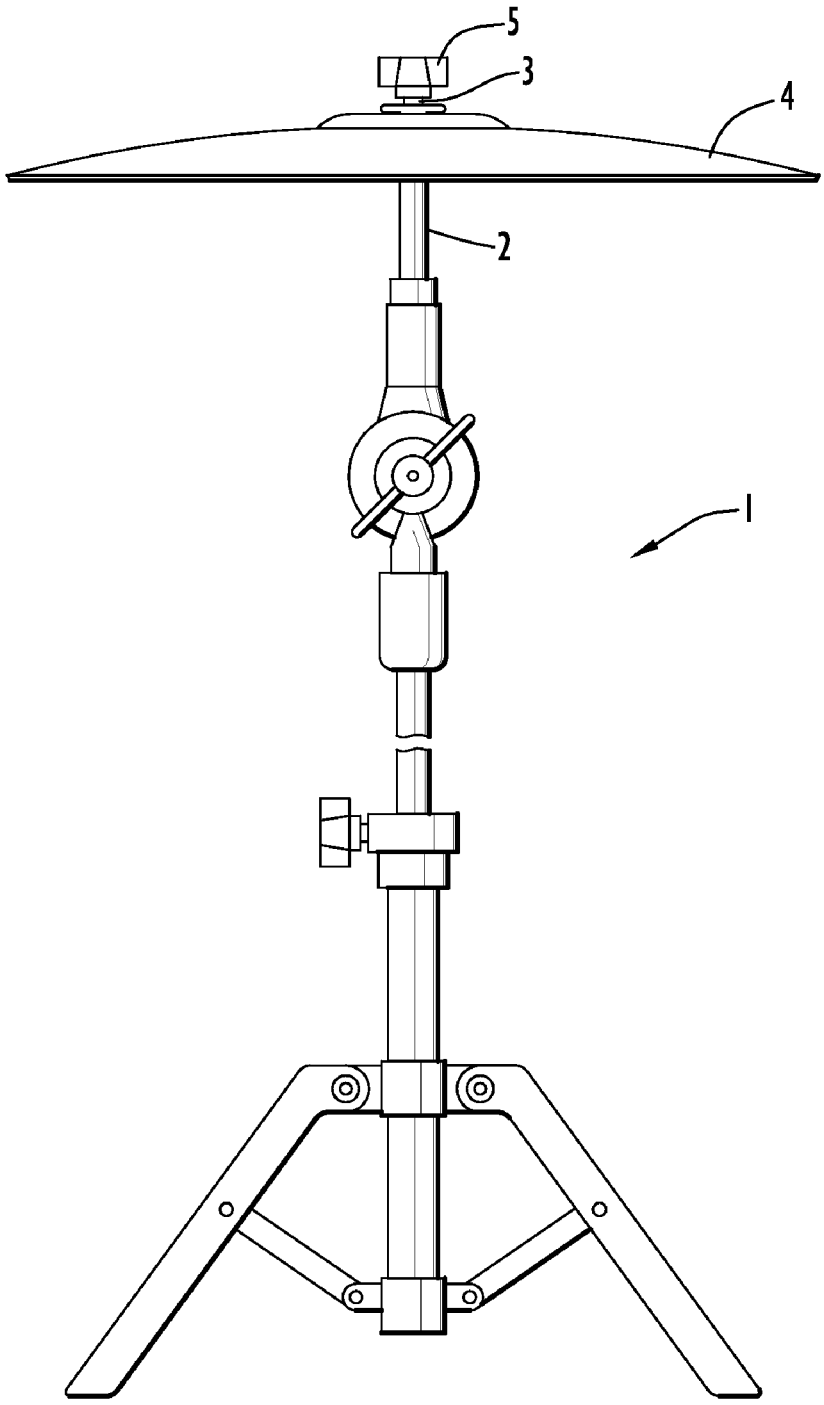
FIG. 14 is a view in elevation of a cymbal stand with which the present invention is used.

Referring first to FIGS. 1 and 14, a conventional prior art cymbal stand 1 typically includes a support rod or post 2 which terminates at its upper extremity in a reduced threaded end portion 3 over which a standard cymbal 4 can be fitted and secured in place by a wing nut fastener 5 (FIG. 14). Wing nut fasteners are generally used in the music industry to secure the cymbal 4 in place on the conventional stand 1. Alternatively, as described in the Hoshino patent and as illustrated in FIG. 1, an internally threaded reversible fastener 7 (FIG. 1) with a self-contained cymbal-retaining flange may be employed to secure the cymbal in place. A washer-like rounded metal disc or cup 8 is typically fitted against a small shoulder 9 on the rod 2 and serves as the vertical support for the cymbal 4. A felt washer or pad 11 may be fitted over the reduced end portion 3 of the rod 2 so that it rests on the cup 8 to serve as a buffer to cushion the cymbal 4. Conventional means are provided, as shown in FIG. 14, to tilt and raise or lower support rod to the percussionist's preference relative to a tripod floor mount.

Referring to FIGS. 2-5 and 10, a cymbal support member of the present invention is in the form of a grommet-like member 20 made of resiliently flexible material such as rubber or a suitable polymer. The grommet-like member 20 has a central longitudinal axis (see arrow 24) and includes a short generally cylindrical base portion 21 having an outside diameter larger than the diameter of the cymbal central aperture 17. A top portion 22 of member 20, having a cylindrical configuration, also has an outside diameter larger than the cymbal central aperture diameter. A neck portion 23 extends from and between the base and top portions, is generally cylindrical, and has an outside diameter smaller than the cymbal central aperture diameter. A central longitudinal bore 25 is defined along the central longitudinal axis through the entireties of the base, top and neck portions, and has a diameter equal to or slightly larger than the diameter the threaded section of the support rod.

Figure 2:
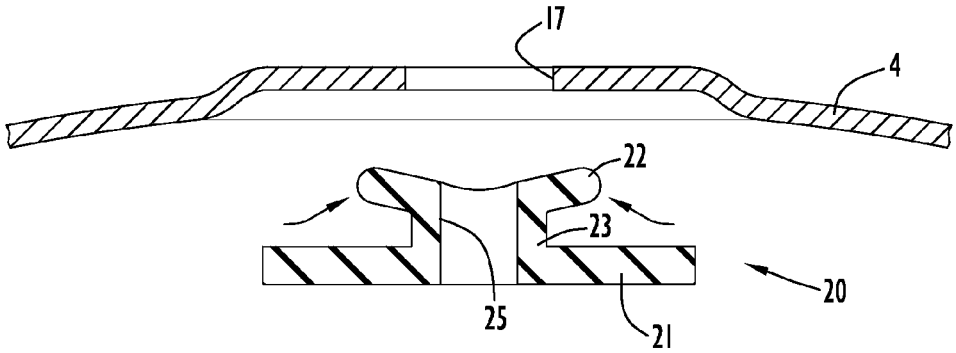
FIG. 2 is an elevation view in section of a cymbal and a first embodiment of a grommet according to the present invention shown during the initial part of the procedure for attaching the grommet to the cymbal.
Figure 3:
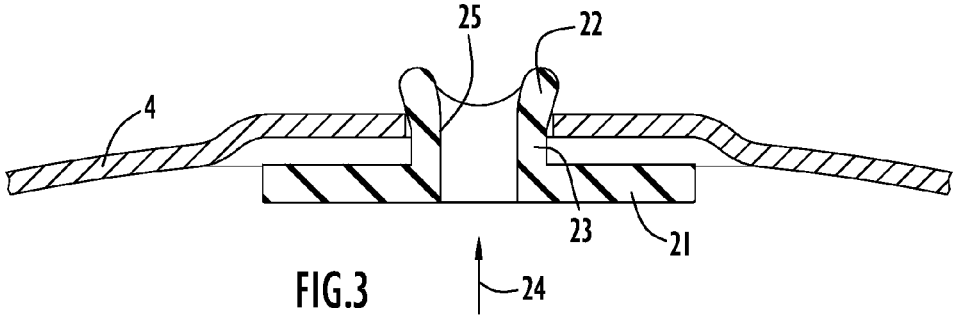
FIG. 3 is an elevation view in section of the cymbal and grommet of FIG. 2 shown during a subsequent portion of the procedure for attaching the grommet to the cymbal.
Figure 4:
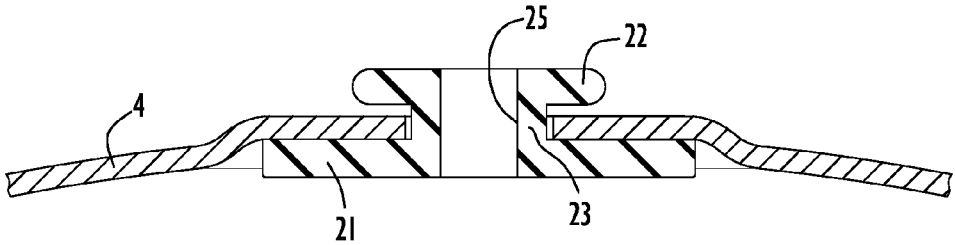
FIG. 4 is an elevation view in section of the cymbal and grommet of FIG. 2 shown with the grommet attached to the cymbal.
Figure 5:
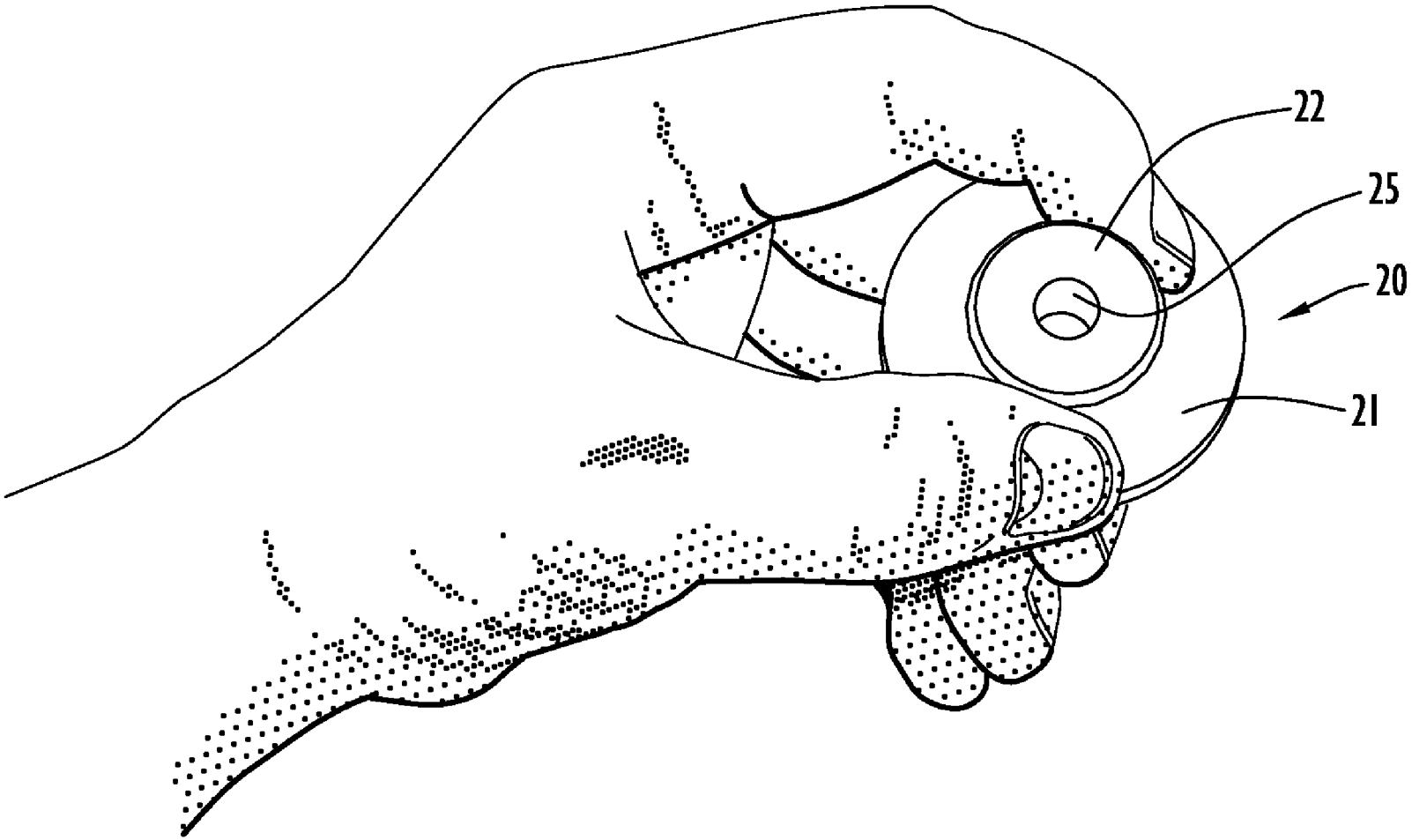
FIG. 5 is a view in perspective showing the grommet of the present invention being grasped by a hand prior to attachment of the grommet to a cymbal.

Top portion 22 is resiliently flexible and is normally configured to permit it to be temporarily compressed between a person's thumb and forefinger (see FIG. 5) and inserted through the cymbal central aperture 17 from the bottom surface of the cymbal. FIG. 2 illustrates the initial deformation of the top portion immediately prior to its insertion through the aperture. FIG. 3 illustrates the top portion deformed as it is passing through the aperture. Once the top portion has been extended fully through aperture 17 it is no longer compressed and is therefore permitted to resiliently return to its uncompressed quiescent or normal configuration. As a result, the neck portion 23 is disposed within aperture 17 and precluded from inadvertent removal therefrom by the flat flange-like configurations of the adjacent surfaces of the larger diameter top and base portions of the member.

In the embodiment illustrated in FIGS. 2-5, the entire grommet-like member 20 is molded or otherwise formed as a single unit of resilient flexible material. It will be appreciated, however, that only the top portion 22 is required to be resiliently flexible to permit it to be compressed and inserted through the cymbal aperture. Accordingly, it is within the scope of the present invention to provide the neck portion 23 and base portion 21 with different material characteristics, or even different materials, than the top portion material.

Figure 10:
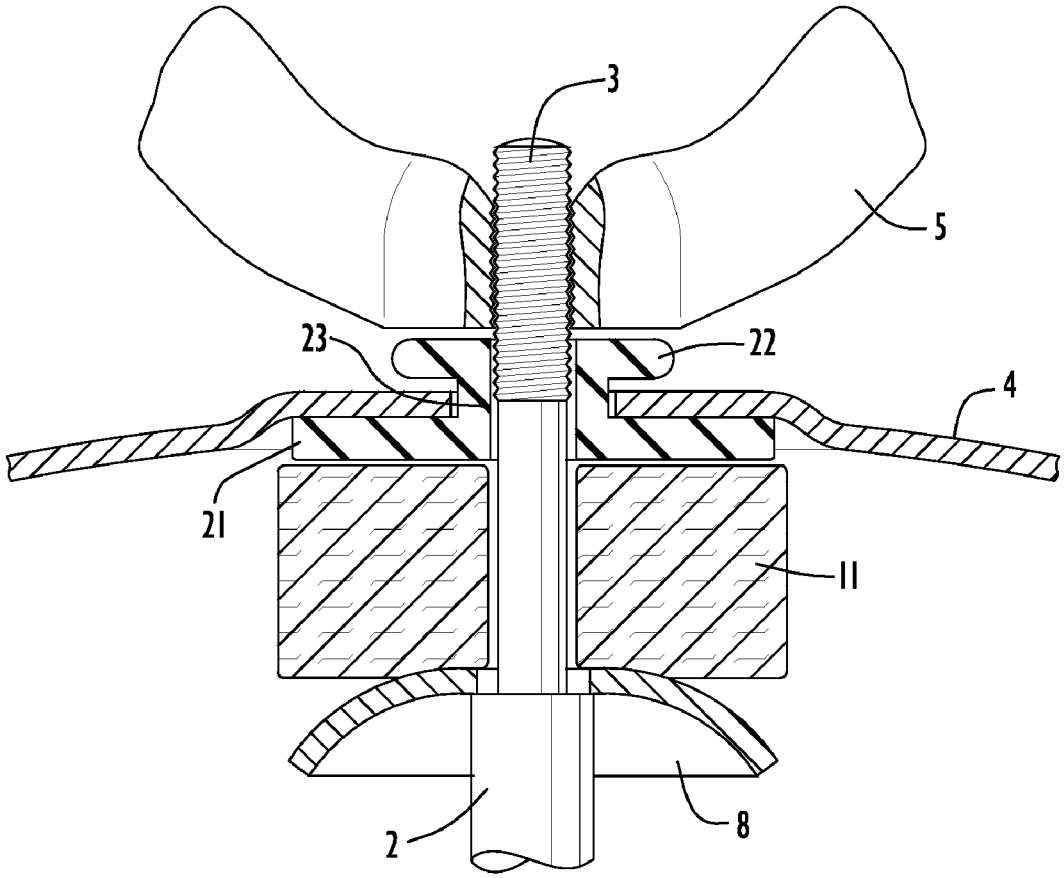
FIG. 10 is an elevation view in section of a cymbal mounting arrangement using the grommet of FIG. 6 tightened by a wing nut.

The resulting structure is a pliable mounting grommet attached to a cymbal at the rim of the cymbal aperture and includes a relatively large diameter base or lower portion, a reduced diameter neck and an annular upper flange top portion of greater diameter than the neck and the cymbal aperture. The cymbal is securely disposed between the grommet base and upper flange. In this manner the mounting grommet is readily removed from the stand along with the cymbal for storage, transport or mounting on another stand. The grommet-like member protects the annular edge of the cymbal aperture from wear against the rod of the support stand during use without restricting desired tilt or wobble. The wing nut that threadedly engages the upper end of the stand rod can be tightened to the desired degree by resiliently compressing the upper flange of the grommet longitudinally downward along the rod. As illustrated in FIG. 10, a felt washer may be used in conjunction with the grommet-like member and placed between the disc 8 and the base portion 21.

In the embodiment of FIGS. 2-5 and 10 the top surface of the mounting grommet base is a flat annular flange-like member of greater diameter than the upper flange. The top annular surface of the base is of greater diameter than the cymbal aperture so that the interior portion of the cymbal can rest on that surface. The bottom surface of the base is adapted to rest either on a convex support disc conventionally secured to the rod on the support stand or a centrally apertured cushion of felt or other material surrounding the rod in a position between the mounting grommet and the support disc.

Figure 13:
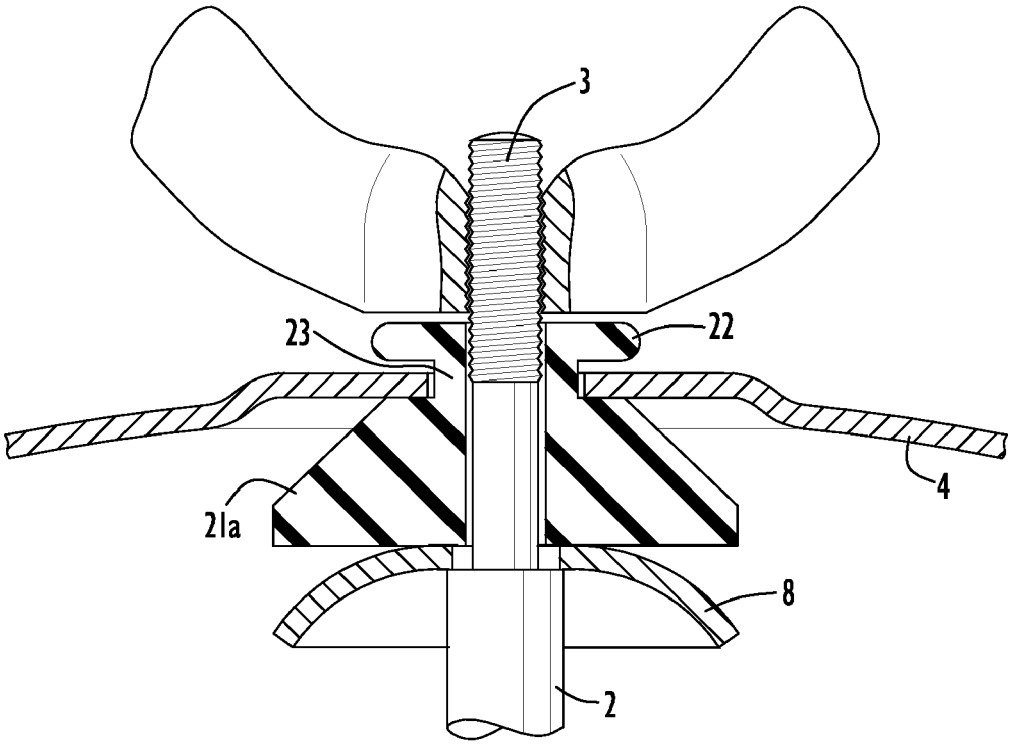
FIG. 13 is an elevation view in section of a cymbal mounting arrangement using the grommet of FIG. 2 tightened by a wing nut.

In a second embodiment the base may have a frustoconical configuration as illustrated in FIG. 13 wherein the base diverges downwardly and terminates in a relatively large diameter annular bottom surface adapted to rest either on the convex support disc secured to the rod on the support stand or the centrally apertured cushion of felt or other material.

For either embodiment, the top portion of the mounting grommet of the present invention can be hand-pressed or snapped through the cymbal aperture such that the neck portion firmly resides in the aperture, allowing the cymbal and grommet to be removed from a support stand as a unit and placed on other support stands.

The mounting grommet-like member is compatible with most cymbal mounting systems. If the threaded portion of the support rod is not long enough, a spacer may be used to raise the grommet to a point where the wing nut can make contact with the upper flange of the mounting grommet.

Another advantage of the mounting grommet-like member of the present invention is the reduction in mounting parts required compared to prior art mounting arrangements.

The mounting grommet 20 contacts the cymbal along a relatively smaller annular area than that occupied by the thick felt spacers commonly employed. This tends to decrease the damping effect on the natural resonance of the cymbal, thereby improving tonal effects.

The height of the neck of the mounting grommet is selected to be greater than the thickness of the cymbal at the aperture 17 to allow the cymbal to freely move (i.e., tilt and wobble) in the neck portion. However, the same pliant resilience of the mounting grommet that facilitates its insertion into the cymbal aperture also permits the upper flange to be downwardly compressed by the wing nut sufficiently to restrict tilt and wobble to the extent desired by the percussionist.

Figure 6:
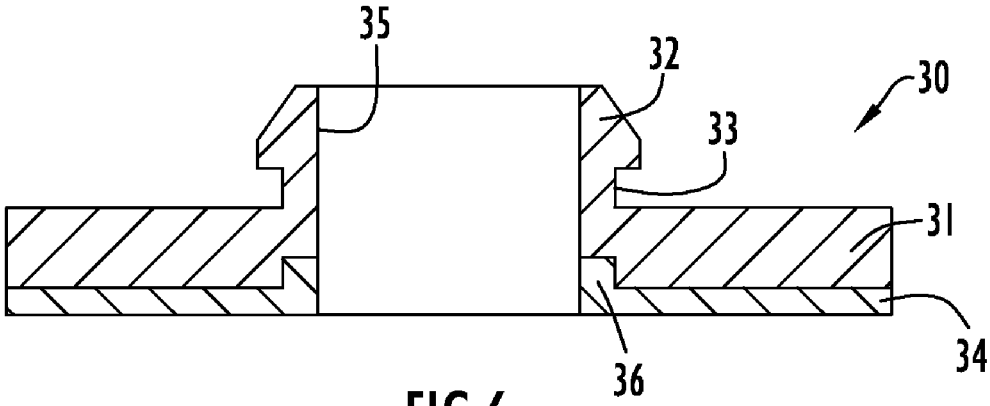
FIG. 6 is an elevation view in section of another grommet according to the present invention with a washer bonded thereto.
Figure 7:
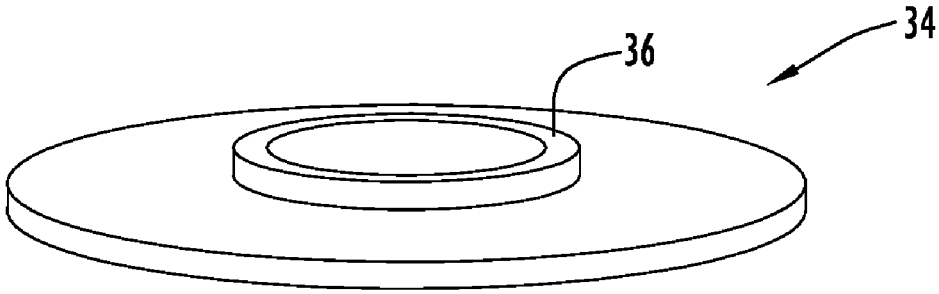
FIG. 7 is a view in perspective of the washer of FIG. 6.

Referring to FIGS. 6 and 7, in accordance with another aspect of the present invention, a non-metal rigid washer may be permanently bonded to the bottom surface of the grommet-like member to serve the function of preventing the grommet from slipping past the annular stop or shoulder on the support rod. FIG. 6 also illustrates a different possible configuration for the top portion of the grommet member, which configuration is not limited to use with the bonded washer. More specifically, grommet-like member 30 includes a short generally cylindrical base portion 31 having an outside diameter larger than the diameter of the cymbal central aperture 17. A top portion 32 of member 30, having a frustoconical configuration, also has an outside diameter at its bottom end larger than the cymbal central aperture diameter. A neck portion 33 extends from and between the base and top portions, is generally cylindrical, and has an outside diameter smaller than the cymbal central aperture diameter. A central longitudinal bore 35 is defined along the central longitudinal axis of the member through the entireties of the base, top and neck portions, and has a diameter equal to or slightly larger than the diameter the threaded section of the support rod. Bore 35 widens in a single stepped manner proximate the lower end of base portion 31 to define a downwardly-facing recessed annular shoulder. A washer 34 is in the form of a flat annular disc having a central aperture with a diameter corresponding to that of aperture 35. A raised annular section 36 on the top surface of the washer is configured to fit precisely against the recessed annular shoulder in the bottom surface of member 30 when the washer and member 30 are placed in abutting relation. Washer 34 is bonded to member 30 by any suitable means depending on their materials. Since the washer is preferably non-metal, the parts may be bonded during a molding process. Alternatively one may use adhesive, heating, ultrasonic welding, or any other suitable technique. The raised annular section 36 provides enhanced lateral stability for the washer relative to member 30. The washer enhances the duty life of the grommet-like member. By using non-metal material for the washer, the washer is rendered more compatible than a metal washer for use with the rubber or polymer grommet-like member.

Figure 8:
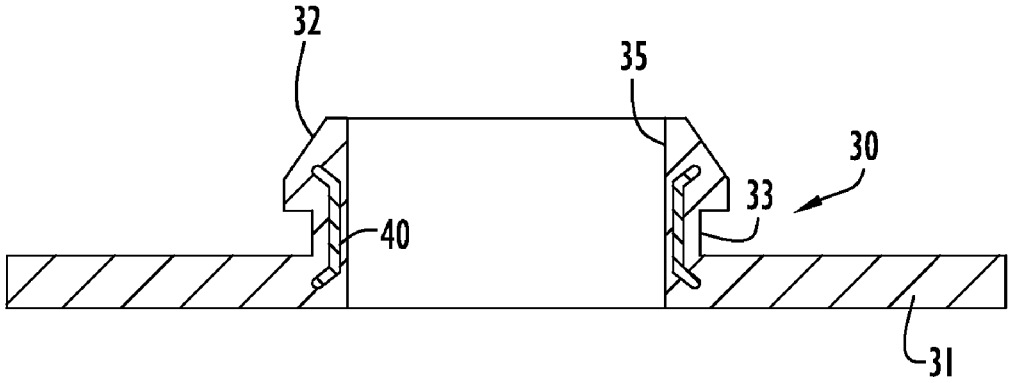
FIG. 8 is an elevation view in section of the grommet of FIG. 6 with an interior reinforcing member.
Figure 9:
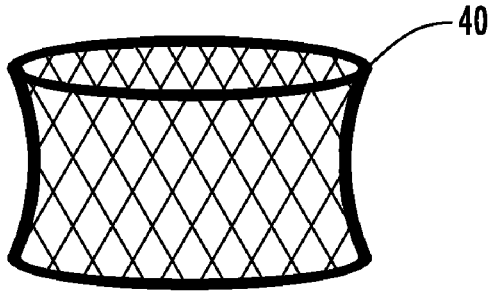
FIG. 9 is a view in perspective of the reinforcing member of FIG. 8.

In accordance with another aspect of the invention, and as illustrated in FIGS. 8 and 9, strengthening material is embedded in the neck or small diameter portion of the grommet-like member. In the preferred embodiment the strengthening material takes the form of a mesh sleeve that, for example, can be similar to woven steel braiding used for coaxial cable shielding but preferably not metallic. Examples of preferred material for the mesh sleeve are carbon nanotubes, aramid (i.e., aromatic polyamide) fibers such as KEVLAR, high strength glass fibers, graphite fibers, graphite whiskers and silicon carbide fibers or graphite fibers. Broadly speaking, the fiber material may be any fiber suitable for the described strengthening function and for embedding in the grommet during molding. The sleeve is embedded in the grommet-like member during the member molding process, typically using conventional insert molding techniques. In particular, mesh sleeve 40 of strengthening material is embedded primarily in the neck portion 32 of the grommet-like member, and may extend into the top portion 32 and base portion 31. Although the strengthening material is preferably in the form of a sleeve to facilitate molding, it can be of any configuration that will provide the strengthening feature without sacrificing the resilient flexibility required for the top portion 32 to be inserted through the cymbal aperture.

Figure 11:
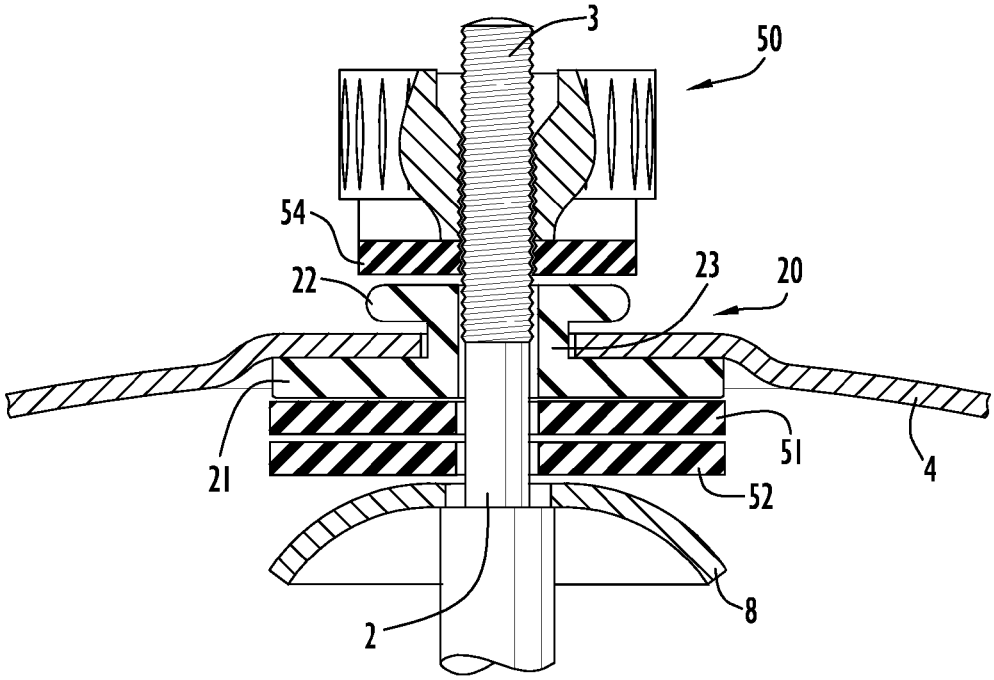
FIG. 11 is an elevation view in section of a cymbal mounting arrangement using the grommet of FIG. 6 tightened by a thumb screw according to the present invention.
Figure 12:
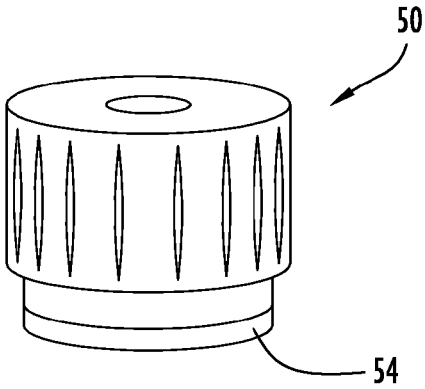
FIG. 12 is a view in perspective of the thumb screw on FIG. 11.

Another feature of the present invention, as illustrated in FIGS. 11 and 12, involves the use of a thumbscrew, rather than a wing nut, with a rubber or plastic compound bottom section to contact the cymbal. The thumbscrew 50 is used to attach the cymbal and at the same time enhance the usefulness of the grommet-like member described hereinabove, if such a grommet is used. In other words, the thumbscrew feature may be used independently of the grommet-like member, if desired.

FIG. 11 shows grommet-like member 20 with a thumbscrew replacing the wing nut and one or more washers 51, 52 disposed below the grommet to locate the cymbal at the desired height. The thumbscrew is preferably made of metal with integrated interior threads to engage the threaded upper end 3 of the cymbal support rod 2. The outer surface of the thumbscrew is preferably knurled or serrated to facilitate gripping and turning. A composite bottom portion 54 is bonded to the thumbscrew bottom and is made from rubber or suitably soft plastic material. Alternatively, the entire thumbscrew may be made of one or more plastic sections of different Durometer, the upper part being harder than the required softer bottom section.

Although the embodiment of FIG. 11 is shown using the thumbscrew 50 with a soft bottom section 54 in an assembly that includes the grommet-like member 20, it must be stressed that the present invention encompasses the use of such a thumbscrew for mounting and securing cymbals without a mounting grommet-like member.

As previously noted, the grommet-like member of the present invention need not have a cylindrical base portion. An example of such a member is illustrated in FIG. 13 wherein the base portion 21*a* is in the form of a frustoconical member having a periphery that diverges from the neck portion 22.

Although rubber is the preferred material for the grommet-like member of the present invention, it is to be understood that there are numerous polymer materials that have characteristics suitable to achieve the functions and structure described above.

The structure depicted in the drawings are conceptual and do not necessarily illustrate physical and dimensional relationships.

Having described preferred embodiments of new and improved methods and apparatus for mounting cymbals, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A mounting support for a cymbal having a central aperture having a diameter larger than the diameter of a support rod on a conventional cymbal support stand, said cymbal having a predetermined thickness surrounding said aperture, said mounting support comprising:

a grommet-like member having a central longitudinal axis, said member including:

a base portion having a base outside diameter larger than the cymbal central aperture diameter;

a circumferentially continuous annular top portion of resiliently deformable material having an undeformed configuration with a top outside diameter larger than the cymbal central aperture diameter;

a neck portion extending from and between said base and top portions and having a neck outside diameter smaller than the cymbal central aperture diameter, and a neck height greater than the predetermined thickness of the cymbal;

wherein a central longitudinal bore is defined to extend lengthwise along said central longitudinal axis through the entireties of said base, top and neck portions such that the bore is continuously circumferentially enclosed throughout its entire length;

wherein said top portion is resiliently deformable to at least one deformed configuration to permit the top portion to be forcibly inserted through the cymbal central aperture and return to its undeformed configuration and thereby place the neck portion within the cymbal central aperture; and wherein said grommet-like member is configured with said neck height sufficiently short such that, when said grommet-like member is inserted into and retained in said cymbal aperture with said neck portion extending through said aperture, said base portion is disposed beneath and adjacent the cymbal, and said top portion is disposed above and sufficiently proximate the cymbal to be adjustably compressible against the cymbal to permit selective restriction of cymbal tilt and wobble.

2. The mounting support of claim 1 wherein the entire grommet-like member is made of a resiliently flexible material.

3. The mounting support of claim 1 wherein at least the top and neck portions of the grommet-like member are made of a resiliently flexible material.

4. The mounting support of claim 3 wherein at least a lowermost section of the base portion is made of a material having a greater hardness than said resiliently flexible material.

5. The mounting support of claim 4 wherein said lowermost section of the base portion is a non-metal rigid washer permanently bonded to the bottom surface of the grommet-like member to prevent the grommet-like member from slipping past an annular stop on the support rod of the support stand.

6. The mounting support of claim 1 further comprising strengthening material embedded in the neck portion to reduce wear and tear.

7. The mounting support of claim 6 wherein said strengthening material is a mesh annular sleeve.

8. The mounting support of claim 6 wherein said strengthening material is non-metal.

9. The mounting support of claim 1 further comprising a thumbscrew for threadedly engaging the support rod above said grommet-like member to selectively apply a vertical downward force to compress the top portion against the cymbal to hold the grommet-like member and cymbal in place on the support rod, said thumbscrew having an upper section of hard material integral with a base section of softer material to abut said grommet-like member.

10. The mounting support of claim 9 wherein said thumbscrew has an outside diameter larger than the outside diameter of said top portion and smaller than the outside diameter of said base portion.

11. The mounting support of claim 1 wherein said base portion has a frustoconical configuration that diverges away from said neck portion.

12. The mounting support of claim 1 wherein said base portion has a cylindrical configuration that is axially shorter than the combined axial length of said neck and top portions.

13. The mounting support of claim 1 wherein said top portion includes a frusto-conical periphery portion that diverges in a direction toward said neck portion.

14. The mounting support of claim 1 wherein said top portion has an annular periphery.

15. The mounting support of claim 1 wherein central longitudinal bore has a diameter along its entire length equal to or slightly larger than the support rod diameter.

16. The mounting support of claim 1 wherein said top portion has a bottom surface defining a first flat flange-like member, and said bottom portion has a top surface including a second flat flange-like member, said first and second flange-like members being spaced to be adjacent opposite surfaces of said cymbal when the neck portion is within the cymbal central aperture to define stop members preventing inadvertent removal of said neck portion from the cymbal central aperture.

17. The mounting support of claim 1 wherein said bore has a substantially constant diameter throughout its entire length.

18. A method of supporting a cymbal having a central aperture on a support rod extending axially on a conventional cymbal support stand, said method comprising the steps of:

providing a circumferentially continuous annular grommet-like member having a base portion and a circumferentially continuous annular top portion of resiliently deformable material, each with outside diameters larger than the cymbal central aperture diameter, and an intermediate neck portion with an outside diameter smaller than the cymbal central aperture diameter, wherein a bore is defined axially through the entire axial length of said grommet-like member and is entirely circumferentially enclosed throughout said axial length;

resiliently deforming the material of said top portion while forcing it through the cymbal central aperture to dispose the neck portion within the central aperture, said base portion adjacent a bottom surface of the cymbal, and said top portion sufficiently proximate a top surface of the cymbal to be adjustably compressible against the cymbal; and disposing the support rod through the entire axial length of said bore and grommet-like member to position the cymbal relative on the rod.

19. The method of claim 18 further comprising the step of preventing the grommet-like member from slipping past an annular stop on the support rod of the support stand by permanently bonding a non-metal rigid washer to the bottom surface of the grommet-like member.

20. The method of claim 18 further comprising the step of strengthening a neck portion of the grommet-like member disposed in the central aperture by embedding a strengthening material in the neck portion.

21. The method of claim 18 further comprising the step of tightening the cymbal in place on the support rod with a thumbscrew having an upper section of hard material integral with a base section of softer material to abut said grommet-like member.

22. The method of claim 18 further comprising the steps of:

providing a bottom surface of said top portion as a first flat flange-like member;

providing a top surface of said base portion as a second flat flange-like member; and wherein the step of resiliently distorting includes disposing said first and second flat flange-like members adjacent the top and bottom surfaces, respectively, of said cymbal to prevent inadvertent removal of said neck portion from the cymbal central aperture.

23. The method of claim 18 further including providing said bore through the entireties of said base, top and neck portions with a diameter throughout its length equal to or slightly larger than the diameter a threaded section of the support rod.

24. A unitary product comprising:

a cymbal having top and bottom surfaces and a central aperture with a diameter larger than the diameter of a support rod on a conventional cymbal support stand; and a grommet-like member having a central longitudinal axis, said member including:

a base portion having a base outside diameter larger than the cymbal central aperture diameter;

a circumferentially continuous annular top portion of resiliently deformable material having an undeformed configuration with a top outside diameter larger than the cymbal central aperture diameter but smaller than the base outside diameter;

a neck portion extending from and between said base and top portions and having a neck outside diameter smaller than the cymbal central aperture diameter;

wherein a central longitudinal bore is defined along said central longitudinal axis through the entireties of said base, top and neck portions;

wherein said grommet-like member is retained in said cymbal aperture with said neck portion extending through said aperture, said base portion adjacent the bottom surface of the cymbal, and said top portion sufficiently proximate the top surface of the cymbal to be adjustably compressible against the cymbal.

25. The unitary product of claim 24 wherein central longitudinal bore has a diameter along its entire length equal to or slightly larger than the support rod diameter.

26. The unitary product of claim 24 wherein said top portion has a bottom surface defining a first flat flange-like member, and said bottom portion has a top surface including a second flat flange-like member, said first and second flange-like members being spaced to be adjacent opposite surfaces of said cymbal when the neck portion is within the cymbal central aperture to define stop members.

* * * * *